US005762032A

United States Patent [19]

Patel

[11] Patent Number: 5,762,032

[45] Date of Patent: Jun. 9, 1998

[54] FIELD ADJUSTABLE BOLTLESS STIRRUP

[75] Inventor: Kasanbhai C. Patel, Windsor Locks, Conn.

[73] Assignee: Combustion Engineering, Inc., Windsor, Conn.

[21] Appl. No.: 771,551

[22] Filed: Dec. 23, 1996

[51] Int. Cl.[6] ..... F22B 37/24

[52] U.S. Cl. ..... 122/493; 122/493; 122/511

[58] Field of Search ..... 122/493, 496, 122/511

[56] References Cited

U.S. PATENT DOCUMENTS

| | | | |
|---|---|---|---|
| 4,537,157 | 8/1985 | Volks | 122/493 |
| 4,756,278 | 7/1988 | Fournier | 122/493 |
| 5,207,184 | 5/1993 | Kreider | 122/511 |
| 5,282,442 | 2/1994 | Payne | 122/511 |

FOREIGN PATENT DOCUMENTS

| | | |
|---|---|---|
| 0118601 | 10/1978 | Japan . |
| 0132601 | 11/1978 | Japan . |
| 0110305 | 5/1991 | Japan . |

*Primary Examiner*—Ronald C. Capossela
*Attorney, Agent, or Firm*—Robert S. Smith

[57] ABSTRACT

A stirrup apparatus for cooperation with an associated buckstay that has at least one flange and which extends around an associated furnace. The stirrup apparatus includes a wall channel extending generally horizontally around the associated furnace. The apparatus also includes an elongated bent plate having first and second ends, the plate being elongated intermediate the first and second ends. The first and second ends are welded to the wall channel at spaced parts of the wall channel with an axial part of the plate intermediate the first and second ends spaced from the wall channel. At least a first elongated bar is welded on a side of the bent plate that faces the wall channel and extends generally in a direction that is perpendicular to the direction of elongation of the bent plate. The apparatus also includes first and second generally L-shaped retainers, each of the L-shaped retainers is dimensioned and configured to extend from the first elongated bar around an associated flange of the associated buckstay. The first and second L-shaped retainers are welded to the first elongated bar at axially spaced parts thereof. Some forms of the apparatus further includes a second elongated bar welded on a side of the bent plate that faces the wall channel amd extends generally in a direction that is perpendicular to the direction of elongation of the bent plate. Some embodiments have first and second generally L-shaped retainers that are each dimensioned and configured to extend from the second elongated bar around a flange of the associated buckstay, the first and second L-shaped retainers are welded to the first and second elongated bars at axially spaced parts thereof.

10 Claims, 4 Drawing Sheets

FIELD ADJUSTABLE BOLTLESS STIRRUP

TECHNICAL FIELD

The invention relates to steam generation apparatus such as large utility boilers and particularly to apparatus for connecting the buckstay structure to the waterwall of the furnace in such apparatus. Large utility boilers are typically disposed in a frame that is provided to withstand the internal furnace gas pressure. As the furnace approaches operating temperature, the furnace walls expand vertically and horizontally. Additionally, the pressure excursions within the furnace, either an increase or a decrease in pressure within the furnace, cause a resultant additional flexing of the tube walls either inwardly or outwardly in a horizontal direction.

It is customary in the art to locate buckstays in the form of I-beams adjacent to opposite walls of the furnace so that the buckstays can be attached to the furnace wall to maintain the adjacent wall in a flat condition. Typically both vertical and horizontal structural members are used that are respectively known as vertical and horizontal buckstays.

Since the furnace walls change in temperature from ambient to temperatures in the order of 400 degrees Centigrade, while the buckstays are at essentially ambient temperature at all times, it is essential that provision be made to permit appropriate expansion. This is accomplished by carrying the buckstays on the wall in a manner which permits the vertical expansion of the walls. The opposing buckstays are tied to each other through connections which are at the boiler wall temperature.

Typically, the horizontal buckstays are disposed in bands around the perimeter of the furnace tube walls at vertically spaced intervals (often between 10 and 15 feet) throughout the height of the furnace wall. Horizontally, the buckstays on opposite walls of the furnace are interconnected through buckstay ties so that the reaction of one buckstay is resisted by the reactions of the buckstay on the opposing wall so it can counteract the pressure forces acting on the furnace walls. It has been customary to provide vertical support members (levelers) to interconnect adjacent buckstays with a connection that permits a sliding action that permits relative movement between the furnace tube wall with which a buckstay cooperates and the buckstays themselves. As the furnace expands in a vertical direction the effect on the various levels of buckstays will be different.

Because of the temperature differential between the furnace wall and the buckstays it is preferred to locate the buckstays a short distance from the furnace wall with insulation therebetween. Apparatus referred to as stirrups are used to make this connection between the furnace wall and the buckstay. The stirrup is a device known in the art which allows gas pressure loading to be transmitted from the furnace tube walls to the buckstay system while allowing unrestricted thermal expansion of the boiler tube wall envelope. Known stirrup constructions are disclosed in U.S. Pat. Nos. 4,395,860, and 4,059,075. These stirrups may be connected to the furnace wall and operate to support the buckstay as well as to prevent relative inward or outward movement between the buckstay and the wall.

The mounting of buckstays and stirrups has been been approached in a number of different ways. See, for example, U.S. Nos. Pat. 5,282,442; 5,299,535; and 5,317,993. All of these patents have been issued to Ronald G. Payne and have the same assignee as the present invention.

The prior art designs are not wholly satisfactory because they often require shop fabrication of parts of the structure. Because of the requirement for shop fabrication of even part of the structure, raw materials such as sheet stock and bar stock must be shipped to a fabrication shop. With the usual prior art construction there are a large number of sizes of stirrup constructions. One factor in the requirement for many different sizes of stirrup is the requirement for the size of the stirrup to vary with the size of the buckstay. The prior art stirrup utilizes a custom cut and notched plate having a notch dimensioned as a function of the horizontal buckstay flange width.

OBJECTS AND SUMMARY OF THE INVENTION

It is an object of the present invention to provide apparatus which require less fabrication time and expense than prior art structures.

Another object of the invention is to provide apparatus that will utilize more off the shelf metal parts, such as bar stock and plate stock than in the prior art structures.

It is an object of the invention to provide apparatus that can be assembled with less time and expense than is required in the prior art apparatus.

Still another object of the invention is to provide a structure that will require a smaller number of sizes to cooperate with the range of applications encountered in the field than the number of sizes required for the prior art stirrups and thereby reduce the parts that need to be stocked fabrication of new furnaces or repair of existing furnaces.

Yet another object of the invention is to provide a construction that utilizes as many off the shelf parts as possible so that for any one stirrup size there will be an absolute minimum requirement to stock special parts that must be stocked for any given stirrup size.

Another object of the invention is to provide a construction that will not only use off the shelf components but will allow the use of off the shelf components with a minimum of fabrication steps.

It has now been found that these and other objects of the invention may be attained in a stirrup apparatus for cooperation with an associated buckstay that has at least one flange and which extends around an associated furnace. The stirrup apparatus includes a wall channel extending generally horizontally around the associated furnace. The apparatus also includes an elongated bent plate having first and second ends, the plate being elongated intermediate the first and second ends. The first and second ends are welded to the wall channel at spaced parts of the wall channel with an axial part of the plate intermediate the first and second ends spaced from the wall channel. At least a first elongated bar is welded on a side of the bent plate that faces the wall channel and extends generally in a direction that is perpendicular to the direction of elongation of the bent plate. The apparatus also includes first and second generally L-shaped retainers, each of the L-shaped retainers are dimensioned and configured to extend from the first elongated bar around an associated flange of the associated buckstay. The first and second L-shaped retainers are welded to the first elongated bar at axially spaced parts thereof.

Some forms of the apparatus further includes a second elongated bar welded on a side of the bent plate that faces the wall channel amd extends generally in a direction that is perpendicular to the direction of elongation of the bent plate. Some embodiments have first and second generally L-shaped retainers that are each dimensioned and configured to extend from the second elongated bar around a flange of the associated buckstay, the first and second L-shaped retainers are welded to the first and second elongated bars at axially spaced parts thereof.

The invention also includes a furnace apparatus which includes a cavity surrounded on four sides by opposed waterwalls, a plurality of buckstays extending around said cavity, and a stirrup apparatus for cooperation with one of said buckstays and a wall channel extending generally horizontally around the furnace. The apparatus also includes an elongated bent plate having first and second ends, the plate is elongated intermediate said first and second ends. The first and second ends are welded to the wall channel at spaced parts of the wall channel and an axial part of the plate intermediate the first and second ends being spaced from the wall channel. At least a first elongated bar is welded on a side of the bent plate that faces the wall channel and extending generally in a direction that is perpendicular to the direction of elongation of the bent plate and first and second generally L-shaped retainers, each of the L-shaped retainers is dimensioned and configured to extend from the first elongated bar around a flange of the associated buckstay, the first and second L-shaped retainers being welded to the first elongated bar at axially parts thereof.

The apparatus may further include a second elongated bar welded on a side of the bent plate that faces the wall channel. The second elongated bar is welded on a side of the bent plate that faces the wall channel and extends generally in a direction that is perpendicular to the direction of elongation of the bent plate. The first and second generally L-shaped retainers may be dimensioned and configured to extend from the first and second elongated bar around a flange of the buckstay, the first and second L-shaped retainers being welded to the first and second elongated bars at axially spaced parts thereof.

BRIEF DESCRIPTION OF THE DRAWING

The invention will be better understood by reference to the accompanying drawing in which.

DESCRIPTION OF THE PREFERRED EMBODIMENT

Figure 1:
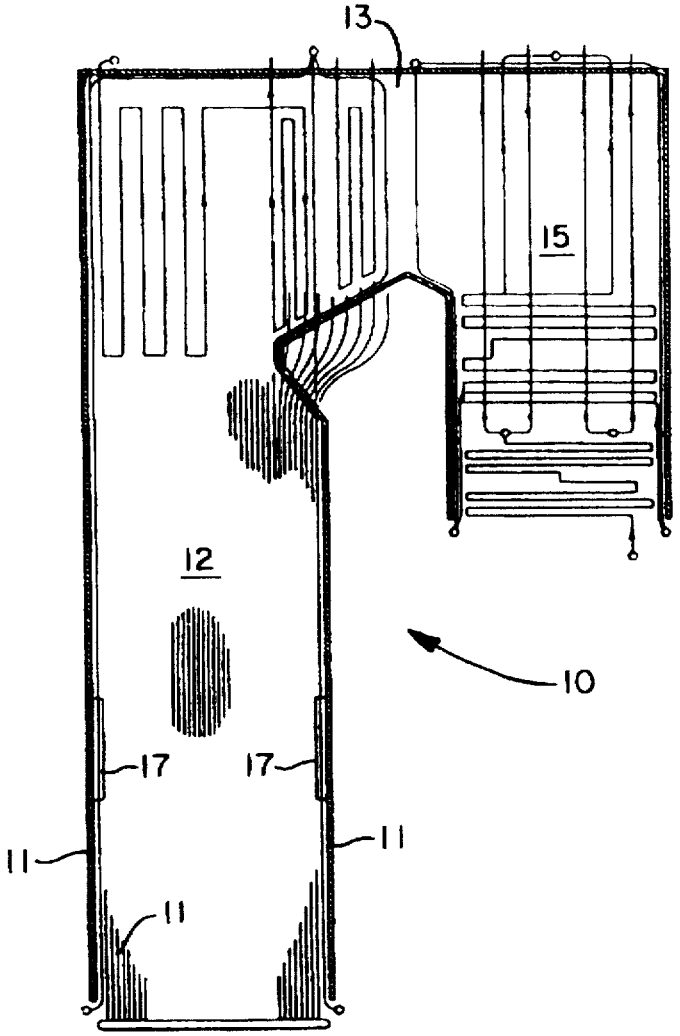
FIG. 1 is a side elevational view of a furnace of a type in which the present invention may be incorporated.

Referring now to FIG. 1 there is shown a conventional furnace 10, having a central cavity 12 surrounded by a front wall, a rear wall and two opposed side walls. The side walls (not shown) are disposed in spaced relationship and join the front wall and the rear wall. Each of these walls is a waterwall 11 comprising a plurality of substantially parallel, substantially coplanar tubular members.

The furnace 10 is vertically disposed and has an outlet for combustion gases at its upper end extending from the rear wall thereof. Extending from this outlet is a lateral gas pass 13 which connects with the upper end of a vertically extending gas pass 15 that extends downwardly in parallel relation with the cavity 12. Combustion gases sequentially pass through the cavity 12, the lateral gas pass 13, the vertically extending gas pass 15 and a stack (not shown). The illustrated furnace 10 includes burners 17. It will be understood the present invention may be incorporated in a wide variety of furnace structures and that the illustrated furnace 10 is only one such furnace.

Figure 6:
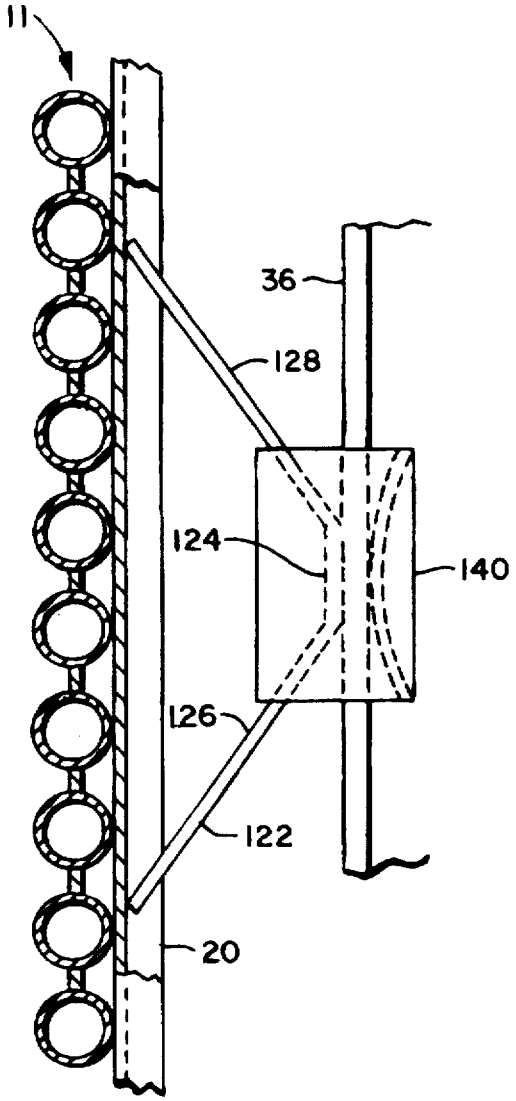
FIG. 6 PRIOR ART
FIG. 6 is a horizontal sectional view, similar to FIG. 2, of a prior art apparatus.
Figure 7:
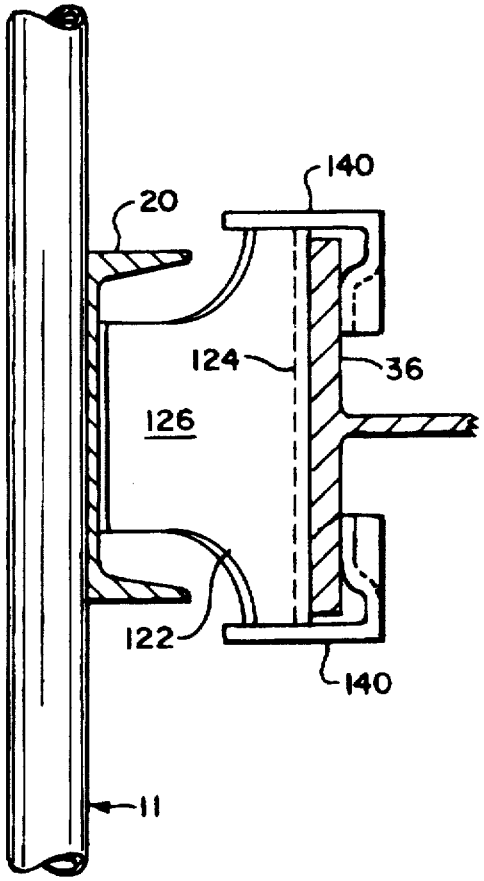
FIG. 7 PRIOR ART
FIG. 7 is an elevational view, similar to FIG. 3, of a prior art apparatus.

One form of the prior art apparatus is shown in FIGS. 6–7. Referring particularly to FIG. 6 the waterwall 11 is shown, somewhat schematically, in section with a plurality of side abutting tubular members. Welded to the waterwall 11 is a wall channel 20. Welded to the wall channel 20 is a bent plate 122. In the preferred embodiment, the bent plate 122 is elongated and has three substantially planar axial portions. The central planar axial portion is identified by the reference numeral 124 in FIG. 6. Extending from the central planar axial portion 124 are respective planar axial portions 126, 128. The included angle between the central planar axial portion 124 and the portion 126 is approximately 145 degrees. Similarly, the included angle between the central planar axial portion 124 and the portion 128 is also approximate 145 degrees.

The bent plate 122 is fabricated with a greater width at the portion 124 than at the portion 126 as best seen in FIG. 7. The dimensional relationship enables the welding of retainers 140 on the ends or sides of the portion 124. These retainers abut the flange of the buchstay 36 and trap the buckstay 36 in position against the bent plate 122 while allowing some relative motion to accommodate expansion that occurs during the operating cycle.

While the prior art structure is satisfactory for many installations it does require fabrication of the bent plate 122 with the greater central width to extend around the flanges of the buckstay 36.

Figure 2:
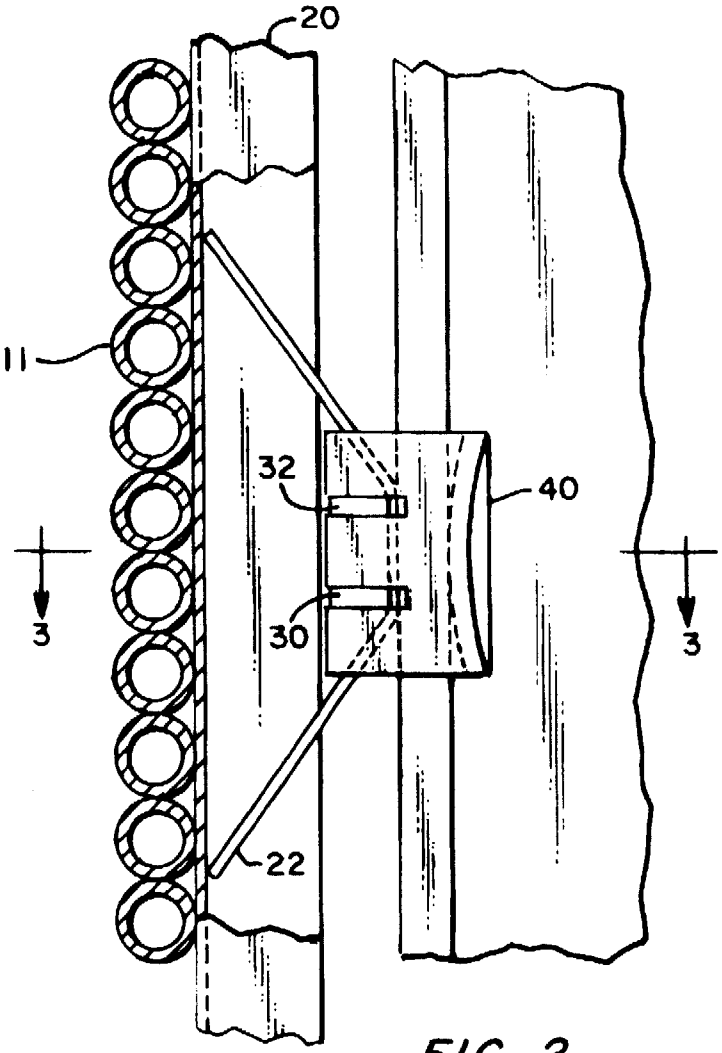
FIG. 2 is horizontal sectional view of the stirrup in accordance with one form of the invention.
Figure 5:
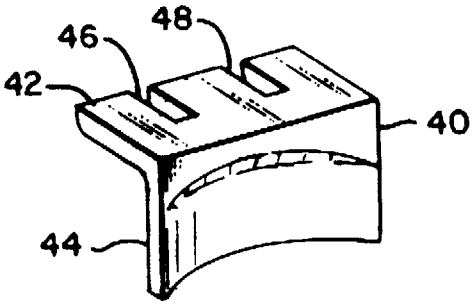
FIG. 5 is a perspective view of the retainer illustrated in FIGS. 2 and 3.
Figure 4:
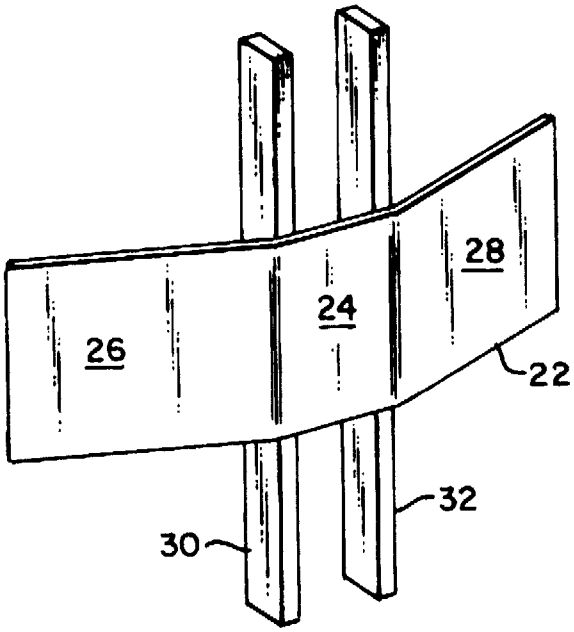
FIG. 4 is an elevational view illustrating a portion of the structure illustrated in FIGS. 2 and 3.

The apparatus in accordance with one form of the present invention is shown in FIGS. 2–5. Referring particularly to FIG. 2 the waterwall 11 is shown, somewhat schematically, in section with a plurality of side abutting tubular members. Welded to the waterwall 11 is a wall channel 20. Welded to the wall channel 20 is a bent plate 22. In the preferred embodiment, the bent plate 22 is elongated and has three substantially planar axial portions. The central planar axial portion is identified by the reference numeral 24 in FIG. 4. Extending from the central planar axial portion 24 are respective planar axial portions 26, 28. The included angle between the central planar axial portion 24 and the portion 26 is approximately 145 degrees. Similarly, the included angle between the central planar axial portion 24 and the portion 28 is approximately 145 degrees.

Two parallel spaced bars 30, 32 are welded to the central planar axial portion 24 of the bent plate 22. More particularly, the parallel spaced bars 30,32 are disposed an spaced relationship and extend vertically with respect to the bent plate. It will be seen that the bent plate 22 is merely a rectangular plate having to bends to produce the desired contours. Thus, the plate 22 may be fabricated by merely cutting the required shape from a metal sheet. Accordingly, the need to inventory parts is minimized. Similarly, it will be seen that the bars 30, 32 are merely axial portions of commercially available bar stock. Thus, the bars 30, 32 may be fabricated by merely cutting the axial parts from commercial bar stock. Accordingly, the need to inventory parts is also minimized by this construction.

Figure 3:
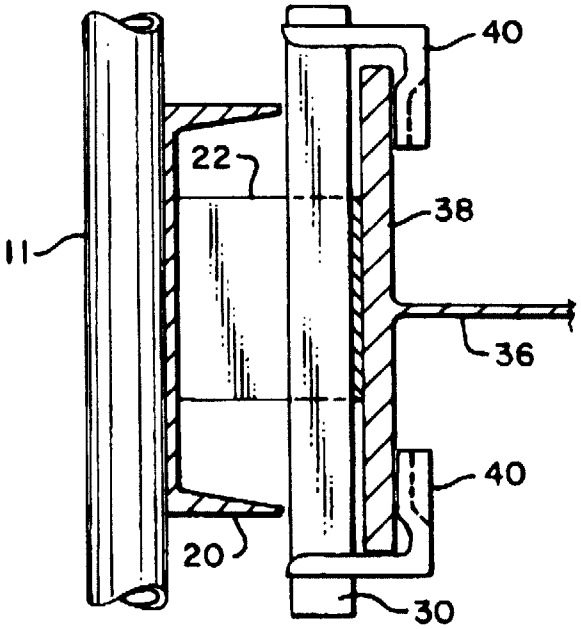
FIG. 3 is a sectional taken along the line 3—3 of FIG. 2.

The complete stirrup is perhaps best visualized in FIG. 3. In this sectional view taken along a vertical plane a tubular member that is a part of the waterwall 11 is visible on the left side of the Figure. Mounted on the waterwall 11 is the bent plate 22 to which are attached the two elongated bars 30, 32.

With this assembly in place on the waterwall 11 a buckstay 36 is positioned with the flange 38 thereof in abutting relationship to the central planar portion 24 of the bent plate 22. Thereafter the buckstay 36 is secured in place by installation of retainers 40, 40. Each retainer 40 has a generally planar first lip 42 and a cylindrical section shaped second lip 44. The first lip 42 and the second lip 44 are disposed in normal relationship. The first lip has slots 46, 48 disposed therein. The slots 46,48 are dimensioned and configured or indecent with the bars 32 that are fixed to the bent plate 22. Accordingly the coupling of the stirrup in accordance with the present invention to the buckstay 36 is achieved by positioning the flange of the buckstay against the central planar portion of the bent plate 22 and then welding the retainers 40, 40 around the buckstay. More specifically, the retainers are welded on the bars 30, 32 with the convex face of the cylindrical section shaped lip 44 disposed in abutting relationship to the flange 38 of the buckstay 36.

It will be seen that the present invention utilizes standard plate stock for the bent plate 22 and standard bar stock for the bars 30, 32. Thus, the apparatus requires only very simple cut to produce the parts required to complete the assembly. Accordingly, the cost of manufacturing and the cost of labor to manufacture the assembly are substantially reduced.

The invention has been described with reference to its illustrated preferred embodiment. Persons skilled in the art of such devices may upon disclosure to the teachings herein, conceive other variations. Such variations are deemed to be encompassed by the disclosure, the invention being delimited only by the following claims.

Having thus described my invention, I claim:

1. A stirrup apparatus for cooperation with an associated buckstay having at least one flange and which extends around an associated furnace which comprises:

a wall channel extending generally horizontally around the associated furnace:

an elongated bent plate having first and second ends, said plate being elongated intermediate said first and second ends, said first and second ends being welded to said wall channel at spaced parts of said wall channel, an axial part of said plate intermediate said first and second ends being spaced from said wall channel;

at least a first elongated bar welded on a side of said bent plate that faces said wall channel and extending generally in a direction that is perpendicular to the direction of elongation of said bent plate; and first and second generally L-shaped retainers, each of said L-shaped retainers being dimensioned and configured to extend from said first elongated bar around an associated flange of the associated buckstay, said first and second L-shaped retainers being welded to said first elongated bar at axially spaced parts thereof.

2. The apparatus as described in claim 1, wherein:

said apparatus further includes a second elongated bar welded on a side of said bent plate that faces said wall channel.

3. The apparatus as described in claim 2, wherein:

said second elongated bar extends generally in a direction that is perpendicular to the direction of elongation of said bent plate.

4. The apparatus as described in claim 3, wherein:

said first and second generally L-shaped retainers are each also dimensioned and configured to extend from said second elongated bar around an associated flange of the associated buckstay, said first and second L-shaped retainers being welded to said first and second elongated bars at axially spaced parts thereof.

5. A stirrup apparatus for cooperation with an associated buckstay extending around an associated furnace which comprises:

a wall channel extending generally horizontally around the associated furnace:

an elongated bent plate having first and second ends, said plate being elongated intermediate said first and second ends, said first and second ends being welded to said wall channel at spaced parts of said wall channel, an axial part of said plate intermediate said first and second ends being spaced from said wall channel;

first and second elongated bars welded on a side of said bent plate that faces said wall channel and extending generally in a direction that is perpendicular to the direction of elongation of said bent plate; and first and second generally L-shaped retainers, each of said L-shaped retainers being dimensioned and configured to extend from said first and second elongated bars around an associated flange of the associated buckstay, said first and second L-shaped retainers being welded to said first and second elongated bar at axially parts thereof.

6. The apparatus as described in claim 5, wherein:

said first and second generally L-shaped retainers are each also dimensioned and configured to extend from said first and second elongated bars around a flange of the associated buckstay, said first and second L-shaped retainers being welded to said first and second elongated bars at respective axially spaced parts thereof.

7. A furnace apparatus which comprises:

a cavity surrounded on four sides by opposed waterwalls:

a plurality of buckstays extending around said cavity;

a stirrup apparatus for cooperation with one of said buckstays;

a wall channel extending generally horizontally around the furnace:

an elongated bent plate having first and second ends, said plate being elongated intermediate said first and second ends, said first and second ends being welded to said wall channel at spaced parts of said wall channel, an axial part of said plate intermediate said first and second ends being spaced from said wall channel;

at least a first elongated bar welded on a side of said bent plate that faces said wall channel and extending generally in a direction that is perpendicular to the direction of elongation of said bent plate; and first and second generally L-shaped retainers, each of said L-shaped retainers being dimensioned and configured to extend from said first elongated bar around an associated flange of the associated buckstay, said first and second L-shaped retainers being welded to said first elongated bar at axially parts thereof.

8. The apparatus as described in claim 7, wherein:

said apparatus further includes a second elongated bar welded on a side of said bent plate that faces said wall channel.

9. The apparatus as described in claim 8, wherein:

said second elongated bar is welded on a side of said bent plate that faces said wall channel and extends generally in a direction that is perpendicular to the direction of elongation of said bent plate.

10. The apparatus as described in claim 9, wherein:

said first and second generally L-shaped retainers are each also dimensioned and configured to extend from said first and second elongated bar around a flange of said buckstay, said first and second L-shaped retainers being welded to said first and second elongated bars at axially spaced parts thereof.

* * * * *